US005695609A

United States Patent [19]

Petander et al.

[11] Patent Number: 5,695,609

[45] Date of Patent: Dec. 9, 1997

[54] PROCESS FOR PRODUCING PAPER

[75] Inventors: Lars Harald Petander, Vaasa; Tore Anders Duvnäs, Maksamaa, both of Finland

[73] Assignee: Kemira Oy, Espoo, Finland

[21] Appl. No.: 589,057

[22] Filed: Jan. 19, 1996

Related U.S. Application Data

[63] Continuation of Ser. No. 256,666, filed as PCT/FI93/50019, Jan. 20, 1993, abandoned.

[30] Foreign Application Priority Data

Jan. 20, 1992 [FI] Finland ..... 920246

[51] Int. Cl.[6] ..... D21H 21/10

[52] U.S. Cl. ..... 162/164.1; 162/164.3; 162/164.6; 162/168.3; 162/175; 162/181.1; 162/181.2; 162/181.3; 162/181.4; 162/181.5; 162/181.6; 162/183

[58] Field of Search ..... 162/168.3, 181.5, 162/183, 181.1, 181.4, 181.2, 181.3, 164.1, 164.3, 181.6, 158, 175, 164.6

[56] References Cited

U.S. PATENT DOCUMENTS

| | | | |
|---|---|---|---|
| 4,753,710 | 6/1988 | Langley et al. | 162/168.3 |
| 4,911,790 | 3/1990 | Lindstrom et al. | 162/181.5 |
| 4,980,025 | 12/1990 | Andersson et al. | 162/168.3 |

FOREIGN PATENT DOCUMENTS

| | | |
|---|---|---|
| 0 235 893 | 1/1987 | European Pat. Off. . |
| 874295 | 9/1987 | Finland . |
| SE-8501652-5 | 4/1985 | Sweden . |
| WO 91/07543 | 5/1991 | WIPO . |

*Primary Examiner*—Peter Chin
*Attorney, Agent, or Firm*—Thorpe, North & Western, L.L.P.

[57] ABSTRACT

The invention relates to a process for the production of paper by adding to an aqueous fiber suspension, which possibly contains a filler, auxiliary agents for improving retention and/or dewatering, the auxiliary agents being a cationic long-chain polyacrylamide and an aluminum salt, and by dewatering the obtained fiber suspension during the sheet-forming stage. According to the invention, the said aqueous fiber suspension, possibly containing a filler, to which the cationic long-chain polyacrylamide has first been added, is subjected to shearing forces, whereafter there is added to it, directly before sheet forming, a polymeric aluminum salt or an aluminum salt, in which case a base or an acid is added, when necessary, to the said fiber suspension so that the pH be within the range 7–9 before the sheet forming, in which case aluminum hydroxy particles having anionic surface charges will be formed in situ.

16 Claims, No Drawings

PROCESS FOR PRODUCING PAPER

This application is a continuation of U.S. application Ser. No. 08/256,666, filed Jul. 19, 1994, now abandoned which is a national stage filing of PCT/FI93/50019, filed Jan. 20, 1993.

BACKGROUND OF THE INVENTION

1. The Field of the Invention

The present invention relates to a process for producing paper by adding to an aqueous fiber suspension, which possibly contains a filler, auxiliary agents to improve retention and/or dewatering, the auxiliaries being a cationic long-chain polyacrylamide and an aluminum salt, and by dewatering the fiber suspension during the sheet-forming stage.

2. The Background Art

The invention thus relates to improving retention and dewatering in connection with the production of paper. By means of retention agents, dispersed or emulsified substances present in the pulp, such as fillers, resin dispersions, fines, etc., are flocculated, whereby they are caused to adhere to the paper web. Owing to the high water content of the pulp it is important that the agents used for improving retention also improve dewatering in the wire section of the paper-making machine. High dewatering and high retention are indeed often achieved simultaneously. Dewatering can further be divided into free dewatering and dewatering produced by means of reduced pressure. These may be contradictory, and therefore a precise balance is required between these properties. Since the dewatering of the paper web is most expensive in the drying section of the paper-making machine, maximal dewatering at as early a stage of the process as possible is advantageous. The aim in selecting the retention agent is to obtain a maximally dry paper web both after the wire section and after the press section.

It is known that many advantages can be gained by combining, in a suitable manner, polymeric organic and inorganic components when forming a paper web. Advantage is taken of this commercially by combining a cationic starch and a silica sol in a system called Compozil. According to the Hydrocol combination, a cationic polymer and an anionic swelling bentonite are added to the pulp. In patent application SE-8700058-4, a cationic long-chain polysaccharide, mainly starch, is first added to an alkalized pulp and then an aluminum source, whereupon polymeric aluminum compounds are formed. It is stated that a synergistic effect is produced in this manner.

In patent application SE-8501652-5 it is claimed that, by adding to the pulp first a cationic polyacrylamide instead of a cationic starch or guar gum and subsequently an anionic silica sol, a clearly improved synergistic effect is achieved, especially in a pulp which contains large amounts of interfering substances.

SUMMARY OF THE INVENTION

The object of the present invention is to provide a paper production process wherein paper or board is made from an aqueous suspension containing cellulose fiber and possibly an inorganic filler by using a chemical combination and batching method which improve retention and dewatering.

It is also an object of the invention to provide economical and well-controlled web formation by the process according to the invention, in particular in a neutral and alkaline paper production process. The other objects are a clean machine and good compressibility. Furthermore, the quality properties of the paper must be good.

These objects have been achieved by the process according to the invention, the principal characteristics of which are given in the accompanying patent claims.

The invention is based on the fact that by using a long-chain polyacrylamide and an aluminum salt, a synergistic effect is achieved by adding to an aqueous fiber suspension, which possibly contains a filler, first a cationic long-chain polyacrylamide and then, directly before sheet formation, a polyaluminum salt or a combination which comprises an aluminum salt and a base or an acid which form in situ aluminum hydroxide particles having anionic surface charges, in which case the pH before sheet formation should be within the range 7–9 in order to produce the anionic surface charges of the aluminum hydroxide.

According to the invention, it has been observed that a synergistic effect is produced by a suitable dosage.

DETAILED DESCRIPTION

The present invention provides a number of advantages over the commercial systems and inventions mentioned above. By using a long-chain cationic polyacrylamide, the process is not tied to polysaccharides, for example starch, which need to be used in large amounts. Therefore there is the danger that, when passing into the cycled waters, they cause problems, since they increase the consumption of oxygen in the water and load the waste water treatment plant. Furthermore, they deteriorate dewatering in certain conditions. Polysaccharides often also contain anionic substituents, even though they are cationized. For this reason there may arise interaction with many different pulp components. At the same time the pH dependency also increases. Also, it is not possible to control sufficiently well the constancy of the quality of the polysaccharides, since they are derived from vegetable raw materials. In a cationic polyacrylamide, it is possible to produce, within very wide limits, the desired chain length and charge density.

The known system based on a colloidal silica sol is in general very expensive compared with the system according to the invention.

The known system made up of a polymer and bentonite involves certain disadvantages. It has been noted that bentonite increases the linting and porosity of paper. Its handling requires precise and rather expensive equipment. Controlling the constancy, i.e. the formation, of paper with such a system is problematic, and variations in basis weight may be great.

According to the invention, it is also possible to add to the fiber suspension cationic auxiliary chemicals, which may also be polymeric, before the adding of the cationic polyacrylamide.

According to the invention, the cationic long-chain polyacrylamide is first added to the stock, which is thereafter subjected to shear forces. The aluminum salt is added according to the invention after the shearing stage.

According to the invention, very good retention and dewatering are achieved without the formation suffering to the same extent as when conventional retention agents are used. This is due to the fact that the cationic flocs formed by the cationic long-chain polyacrylamide are comminuted by shearing forces into "microflocs", which are then, before web-forming, bound together with the help of aluminum hydroxide particles which have anionic surface charges. Although these bonds will open in the headbox, they are largely re-formed on the wire, whereupon the "microflocs" of the web provide good formation, and the small even-sized pores of the web, which are not clogged owing to the good retention of fines, provide good dewatering, especially in the press section and the drying section, and often also improved dewatering at the suction boxes of the wire.

In the invention it is possible to use the cationic long-chain polyacrylamide in amounts which are much larger than when batching the retention agents in the conventional manner, just before web forming. Overdosage leads in the latter case even to a situation in which retention is no longer improved or to a situation in which strong flocculation deteriorates paper formation. According to the invention it is possible to use a 1- to 10-fold excess of cationic long-chain polyacrylamide as compared with normal use. The amount depends, for example, on the filler content of the pulp and on the cationic matter contained in the pulp. The amount of long-chain polyacrylamide is preferably about 0.01–0.2% of the dry weight of the pulp. Normally the amount is over 0.02%.

The cationic auxiliary chemical added to the fiber suspension before the cationic polyacrylamide may be, for example, a dry-strength agent, such as a cationic or amphoteric starch or guar gum or a cationic or amphoteric short-chain polyacrylamide. It may also be a wet-strength agent, such as a polyamidamine-epichlorohydrine resin or polyamine-epichlorohydrine resin. It may also consist of cationic substances, so-called fixer chemicals, which neutralize and/or bind anionic interfering substances, such as polyethylene-imines, quaternary polyamines or alum, or polyaluminum chloride.

These cationic chemicals enhance the action of the cationic long-chain polyacrylamide, since they reduce the anionic quality of the pulp suspension and prevent interfering substances from consuming the cationic long-chain polyacrylamide intended for the flocculation of the fiber suspension. Thus the said cationic chemicals ensure that the shearing of the flocs in, for example, the pressure sieve or the feeding pump will result in stable microflocs in the headbox, since they contain a sufficient amount of cationic polyacrylamide and the surface charge of the microflocs is sufficiently cationic in order that they react with aluminum hydroxide particles having anionic charges.

The amount of these cationic chemicals is preferably approx. 0.01–1% of the dry weight of the pulp.

Examples of the cationic long-chain polyacrylamides used in the invention include the following. Especially advantageous are the copolymers of acrylamide and one or two cationic unsaturated monomers. Suitable cationic monomers include dialkylamino(met)acrylates or -(met) acrylamides, in the form of acid salts or quaternary ammonium salts. The alkyl groups may each contain 1–4 carbon atoms, and the amino alkyl group may contain 1–8 carbon atoms. Dialkylaminoethyl(met)acrylates, dialkylaminomethyl(met)acrylamides and N,N-dialkylamino-propyl(met)acrylamides and their quaternary salts are preferred monomers. Other suitable cationic monomers include diallyldialkylammonium chlorides. The polymer may be either linear or cross-linked or partly cross-linked. In this context, cationic polyacrylamides also include the homopolymers of cationic acrylic monomers and the mixed polymers of two or more cationic monomers, at least one of the monomers being acrylic-based.

The aluminum salts used in the invention are water-soluble, and they may be aluminum sulfate, aluminum chloride, aluminum nitrate, or acid aluminum hydrophosphates in which P:Al=1.1:1–3:1.

When these aluminum salts or their mixtures are used, a base is added to form aluminum hydroxide having anionic surface charges. The base used may be, for example, sodium or potassium hydroxide, sodium or potassium carbonate, sodium or potassium metasilicate, sodium or potassium waterglasses, sodium or potassium phosphate or borate, or sodium or potassium aluminate, or mixtures of these.

Aluminate compounds such as sodium aluminate or potassium aluminate can also be used as the water-soluble aluminum salts. In this case, acid is added in order to form, within the pH range 7–9, an aluminum hydroxide having anionic surface charges. The acid used may be mineral acids such as sulfuric acid, hydrochloric acid, nitric acid or phosphoric acid, or organic acids such as oxalic acid, citric acid or tartaric acid. The acid used may also be acid aluminum salts such as aluminum sulfate, aluminum chloride, aluminum nitrate, or various water-soluble aluminum hydrophosphates.

According to the invention it is also possible to use water-soluble polymeric aluminum salts, i.e. polyaluminum salts, so-called basic aluminum salts, which are also called polyaluminum hydroxy salts or aluminum hydroxy salts. According to the invention it is possible to use as these salts, for example polyaluminum sulfate, polyaluminum chloride and polyaluminum chloride sulfate. The polyaluminum salt may, in addition to the chloride and/or sulfate ion, also contain other anions, e.g. phosphate, polyphosphate, silicate, citrate, oxalate, or several of these.

Commercially available polymeric aluminum salts of this type include PAC (polyaluminum chloride), PAS (polyaluminum sulfate), UPAX 6 (silicate-containing polyaluminum chloride), and PASS (polyaluminum sulfate silicate).

The net formula of the water-soluble polyaluminum salt may be, for example $$n[Al_2(OH)_m/Cl)_{6-m}]$$

and its alkalinity may vary so that the m-value ranges from 1 to 5 (alkalinity is respectively 16–83% according to the formula (m:6)×100). In this case the ratio Al/OH is 2:1–1:2.5. n is 2 or higher.

When a polyaluminum compound is used, it is also possible to add a base in order to optimize the Al/OH ratio, even if all of the polyaluminum compounds in accordance with the invention do work as such.

The said base or acid which forms in situ an aluminum hydroxide with the aluminum salt may be added to the fiber suspension, for example before the adding of the cationic long-chain polyacrylamide, or just before the aluminum salt, or after it, or simultaneously with it.

The aluminum hydroxide may also be formed before the moment of adding, for example in the adding tube, or in advance in sol form.

The amount of the aluminum salt, calculated as $Al_2O_3$, is preferably approx. 0.01–1.0% of the dry weight of the pulp.

The paper pulp used may be bleached or unbleached sulfate or sulfite pulp, semichemical pulp, refiner mechanical pulp, groundwood pulp, or mixtures of these. If a filler is present, it is preferably ground or precipitated calcium carbonate, but also other fillers such as kaolin, talc or titanium oxide are possible.

The invention is described below in greater detail with the help of examples.

In the tests described, the pH is approx. 8–8.5, normally approx. 8 when a polyaluminum salt +$CaCo_3$ or alum+a base are used (the Al:OH ratio being approx. 4.5).

EXAMPLE 1

Using a Britt Dynamic Jar as the tester, tests were carried out on a neutral pulp which was made up of bleached birch pulp and bleached pine pulp at a ratio of 60:40. The pulp components had been ground to SR values of 20 and 25. The filler was calcium carbonate, DX-40, 20% of the dry weight of the pulp. The pH of the pulp was approx. 8. In the tester the pulp was of a typical headbox consistency, i.e. approx. 0.8%. After the adding of the retention agent, the pulp was filtered for 30 s, and the ash content was determined.

Tests were performed in this example by using the following systems:

System (I):

500 ml of a dilute pulp was placed in the tester, at 1000 rpm.

After 10 s, polyacrylamide A was added for 5 s. After 10 s, 100 ml of filtrate was filtered for approx. 30 min.

System (II):

Pulp was added as in I, but a base had been added to it for controlling the Al/OH molar ratio approx. 30 min before the pulp was placed in the tester. After the polymer addition, the rotation speed was increased to 1500 rpm for a period of 20 s, whereafter it was returned to 1000 rpm, and alum $Al_2(SO_4)_3 \times 14H_2O$ was added. After 5 s, a filtration was performed as in System I.

System (III):

As System II, but without the addition of a base.

System (IV):

As System II, but without the additions of a base and alum.

System (V):

Was performed in accordance with System II, but without the addition of a base. Instead of the polyacrylamide, a cationic starch, Raisamyl 135, having a degree of substitution of 0.035, was added and was mixed in the same manner as the polymer in System II. Silica sol BMA (Eka Nobel) was used instead of alum.

System (VI):

Was performed as System II, but without the addition of a base to the pulp. Alkali-treated bentonite was added instead of alum (Hydrocol method).

The polyacrylamides A and B in the examples are copolymers of acrylamide and methyl-chloride quaternized dimethylaminoethyl acrylate. Their charge densities and molecular weights are (A) 1 mequiv./g:$7 \cdot 10^6$ and (B) 1.5 mequiv./g:$6 \cdot 10^6$.

Systems I–VI are compared in Table 1.

TABLE 1

| Test No. | System | Polymer/ batch | Alum kg/t | Al/OH | BMA (100%) kg/t | Bentonite kg/t | Filler retention % |
|---|---|---|---|---|---|---|---|
| 1 | 0 test | | | | | | 3 |
| 2 | I | A 300 g/t | | | | | 49 |
| 3 | II (according to inv.) | A 1000 g/t | 5 | 1:3 | | | 63 |
| 4 | II (according to inv.) | A 1000 g/t | 5 | 1:4.5 | | | 61 |
| 5 | II (according to inv.) | A 1000 g/t | 10 | 1:3 | | | 68 |

TABLE 1-continued

| Test No. | System | Polymer/ batch | Alum kg/t | Al/OH | BMA (100%) kg/t | Bentonite kg/t | Filler retention % |
|---|---|---|---|---|---|---|---|
| 6 | II (according to inv.) | A 1000 g/t | 10 | 1:4.5 | | | 81 |
| 7 | II (according to inv.) | A 1000 g/t | 10 | 1:6 | | | 58 |
| 8 | III | A 1000 g/t | 5 | 1:0 | | | 56 |
| 9 | III | A 1000 g/t | 10 | 1:0 | | | 64 |
| 10 | II (according to inv.) | B 1000 g/t | 10 | 1:3 | | | 70 |
| 11 | II (according to inv.) | B 1000 g/t | 10 | 1:4.5 | | | 83 |
| 12 | II (according to inv.) | B | 10 | 1:6 | | | 64 |
| 13 | III | " | 10 | 1:0 | | | 66 |
| 14 | IV | A 1000 g/t | — | | | | 58 |
| 15 | IV | B 1000 g/t | — | | | | 52 |
| 16 | V | Raisamyl 135 5 kg/t | | | 2 | | 48 |
| 17 | V | Raisamyl 135 10 kg/t | | | 2 | | 59 |
| 18 | VI | Hydrocol 862 500 g/t | | | 1 | | 50 |
| 19 | VI | Hydrocol 862 1000 g/t | | | 2 | | 57 |

EXAMPLE 2

This example shows that the process according to the invention improves retention in a paper pulp which contains a cationic pulp starch. The pulp composition is in other respects similar to that in the previous example. The test series was performed in a Britt Dynamic Drainage Jar. The batching methods comply with the methods described in Example 1. The degree of substitution of the cationic starch was 0.035. The starch was added 15 min before the polyacrylamide, and the NaOH for preliminary alkalization 5 min before the polyacrylamide. In this example, the same polyacrylamides A and B were used as in Example 1.

| Test No. | Polymer/ batch kg/t | Aluminum sulfate kg/t | OH:Al | Starch kg/t | Ash retention % | Batching method |
|---|---|---|---|---|---|---|
| 1 | A/0.3 | | | | 52 | I |
| 2 | A/0.5 | | | | 40 | IV |
| 3 | A/0.5 | | | 4 | 37 | IV |
| 4 | A/0.5 | 5 | | 4 | 42 | III |
| 5 | A/0.5 | 5 | 4.5 | 4 | 48 | II (according to invention) |
| 6 | A/0.5 | 5 | 2.25 | 4 | 46 | II (according to invention) |
| 7 | A/0.5 | 3 | 4.5 | 4 | 47 | II (according to invention) |

-continued

| Test No. | Polymer/ batch kg/t | Aluminum sulfate kg/t | OH:Al | Starch kg/t | Ash retention % | Batching method |
|---|---|---|---|---|---|---|
| 8 | A/0.5 | 3 | 2.25 | 4 | 44 | II (according to invention) |
| 9 | B/0.5 | | | | 39 | IV |
| 10 | B/0.5 | 5 | | 4 | 43 | III |
| 11 | B/0.5 | 5 | 4.5 | 4 | 50 | II (according to invention) |
| 12 | B/0.5 | 3 | | 4 | 42 | III |
| 13 | B/0.5 | 3 | 4.5 | 4 | 48 | II (accordin to invention) |

EXAMPLE 3

Further retention tests were performed as in the above examples. The aluminum salt used was aluminum sulfate or a polyaluminum chloride product. The chemical formula of polyaluminum chloride (PAC) is $Al_n(OH)_mCl_{(3n-m)}$. It is made up of a number of aluminum nuclei. The pulp was similar to that in the previous examples. The polyaluminum chloride was batched in a manner similar to that of aluminum sulfate. The difference was that the pre-alkalization was omitted. The ratio OH:Al in the following table indicates, in addition to the degree of prealkalization, also the alkalinity of the polyaluminum product.

The polyacrylamide used was the same polyacrylamide A as in Example 1. The batching methods were as in Example 1.

| Test No. | Polymer/ batch kg/t | Aluminum source 1:Al sulfate 2:PAC kg/t | OH:Al | Ash retention % | Batching method |
|---|---|---|---|---|---|
| 1 | 0.3 | | | 59 | I |
| 2 | 1.0 | | | 57 | IV |
| 3 | 1.0 | 1/10 | 4.5 | 81 | II (according to invention) |
| 4 | 1.0 | 2/5.5 | 1.3 | 79 | III (according to invention) |
| 5 | 1.0 | 2/5.1 | 2 | 84 | III (according to invention) |

EXAMPLE 4

This example shows that the action of polyacrylamide can be enhanced by batching before it another polymer for binding interfering substances. In this case a short-chain cationic polymer (QPOL) was added as a so-called fixing agent before the long-chain polyacrylamide. The product concerned had a particularly high charge density. It was added 10 min before the polyacrylamide, by stirring slowly. The polyacrylamide was the same as in Example 2. The batching methods were as in Example 1.

| Test No. | Polymer/ batch kg/t | Aluminum sulfate kg/t | OH:Al | QPOL kg/t | Ash retention % | Batching method |
|---|---|---|---|---|---|---|
| 1 | 1.0 | 10 | 4.5 | — | 52 | II (according to invention) |
| 2 | 1.0 | 10 | 4.5 | 1.0 | 68 | II (according to invention) |

EXAMPLE 5

The process according to the invention works also when polyaluminum chloride (PAC) is used as the fixing agent before the polyacrylamide. In this case the test conditions are similar to those in Example 4, except that, instead of a quaternary polymer (QPOL), the polyaluminum chloride product used in Example 3 was batched. The batching method was according to Example 3.

| Test No. | Polymer/ batch kg/t | Aluminum sulfate kg/t | OH:Al | PAC kg/t | Ash retention % | Batching method |
|---|---|---|---|---|---|---|
| 1 | I/1.0 | 10 | 4.5 | — | 52 | II (according to invention) |
| 2 | I/1.0 | 10 | 4.5 | 2.5 | 63 | II (according to invention) |

EXAMPLE 6

By the process according to the invention, good dewatering properties are achieved with wood-free fine-paper pulp. The pulps and batching methods were in accordance with Example 1. The dewatering rate was measured by means of a cylindrical tube. At the other end of the tube there was a wire through which the dewatering took place. Before filtration, this tube was used for adding the chemicals to the pulp in the manner described in the previous example, by using a Britt Jar Tester. Thereafter the pulp was poured into a dewatering cylinder and was filtered. The removed filtrate was measured as a function of the time. The pulp was of a type similar to that in the previous examples. In the filtrations, 500 ml of pulp per testing point was used.

| Test No. | Polymer/ batch kg/t | Aluminum sulfate (1) PAC (2) | OH:Al | BMA a) kg/t | Bentonite b) kg/t | Batching method | Dewatering time s/250 ml |
|---|---|---|---|---|---|---|---|
| 1 | A/0.3 | | | | | I | 45 |
| 2 | A/1.0 | | | | | IV | 38 |
| 3 | A/1.0 | (1)10 | | | | III | 36 |

-continued

| Test No. | Polymer/ batch kg/t | Aluminum sulfate (1) PAC (2) | OH:Al | BMA a) kg/t | Bento-nite b) kg/t | Batching method | Dewater-ing time s/250 ml |
|---|---|---|---|---|---|---|---|
| 4 | A/1.0 | (1)10 | 3 | | | II (according to inv.) | 33 |
| 5 | aa)C + A + 1 | (1)10 | 4.5 | | | II (according to inv.) | 27 |
| 6 | bb)D + A/1 + 1 | (2)10 | 4.5 | | | II (according to inv.) | 31 |
| 7 | A/1.0 | (2)5.1 | 2 | | | III (according to inv.) | 30 |
| 8 | D + A/1 + 1 | (2)5.1 | 2 | | | III (according to inv.) | 30 |
| 9 | C/10 | | | 2 | | V | 36 |
| 10 | E/1.0 | | | | 1 | VI | 30 |

a) silica sol, a commercial product
b) alkali-treated bentonite, a commercial product
aa) starch added 10 min before the polyacrylamide
bb) quaternary polymer added 10 min before the polyacrylamide
Polymer A: Polyacrylamide A, see Example 1
C: Cationic potato starch D.S. 0.035
D: Quaternary polyamine
B: Hydrocol 862

EXAMPLE 7

It is shown that the process according to the invention works also when certain other aluminum salts are used. In this example, polyaluminum salts were used which contained silica groups in addition to chloride, or sulfate instead of chloride. The fiber composition in the pulp was similar to that in Example 2. The calcium carbonate concentration was 30%. A cationic polyacrylamide was added to the pulp in a Britt Jar Tester, and it was mixed for 20 s at 1500 $min^{-1}$. Thereafter the aluminum salt was added and was mixed for 10 s at 1000 $min^{-1}$. In the filtering stage the rotation speed was 750 rpm. The ash retention was calculated on the basis of the ash contents of the pulp and the filtrate. The molecular weight of the cationic polyacrylamide was approx. 7 million g/mol and its charge density 1 mequiv./g. Compound A is a silicate-containing polyaluminum chloride and B is polyaluminum sulfate.

| Test No. | Polymer/ batch g/t | Aluminum salt kg/t | Compound | Ash retention % |
|---|---|---|---|---|
| 1 | 1000 | — | | 47 |
| 2 | 1000 | 2 | A | 56 |
| 3 | 1000 | 3 | A | 58 |
| 4 | 1000 | 5 | A | 71 |
| 5 | 1000 | 2.5 | B | 74 |
| 6 | 1000 | 5.0 | B | 77 |

What is claimed is:

1. A process for producing paper comprising:

(a) adding to an aqueous fiber suspension, containing a filler selected from the group consisting of calcium carbonate, kaolin, talc, and titanium oxide, a cationic long-chain polyacrylamide having a molecular weight of about $6\times10^6$ to $7\times10^6$ and a cationic charge of about 1 to 1.5 meq/g in an amount from about 0.01% to about 0.2% of the dry weight of pulp in the fiber suspension;

(b) subjecting said aqueous fiber suspension, to which cationic long-chain polyacrylamide has been added, to shearing forces;

(c) adding to the aqueous fiber suspension, directly before sheet forming, a polymeric aluminum salt or an aluminum salt, in which case a base or an acid is added when necessary such that the pH of the fiber suspension is adjusted to be in the range of pH 7–9 before sheet formation, whereupon aluminum hydroxy particles having anionic surface charges are formed in situ; and (d) forming the aqueous fiber suspension containing the long-chain polyacrylamide and polymeric aluminum salt or aluminum salt into sheets and dewatering the fiber suspension during sheet forming.

2. A process according to claim 1 wherein said fiber suspension may additionally contain cationic auxiliary agents selected from the group consisting of cationic starch, polyamidamine-epichlorohydrine resin, polyethylene imine quaternary polyamines alum and mixtures thereof.

3. A process according to claim 2 wherein said cationic additive is added to said fiber suspension before the adding of the cationic long-chain polyacrylamide.

4. A process according to claims 1, 2 or 3 wherein the polymeric aluminum salt is a water-soluble polyaluminum hydroxy complex with sulfate and/or chloride.

5. A process according to claims 1, 2 or 3 wherein the polymeric aluminum salt is a water-soluble aluminum hydroxy complex with sulfate and/or chloride, which complex contains in addition to a sulfate and/or chloride anion also other anions selected from the group consisting of silicate, oxalate and citrate.

6. A process according claims 1, 2 or 3 further comprising the step of adding said polymeric aluminum salt or the said aluminum salt, calculated as $Al_2O_3$, in an amount from about 0.01% to about 1.0% of the dry weight of the pulp to the fiber suspension.

7. A process according to claims 1, 2 or 3 wherein the aluminum salt is selected from the group consisting of aluminum sulfate, aluminum chloride and aluminum nitrate, in which case a base is added to the fiber suspension in order to form in situ an aluminum hydroxide having anionic surface charges.

8. A process according to claim 7 wherein the polymeric aluminum salt is a water-soluble polyaluminum hydroxy complex with sulfate and/or chloride.

9. A process according to claim 7 wherein the base is added in such an amount that the Al/OH molar ratio is within a range of about 1:2 to about 1:5.

10. A process according to claim 7 wherein the base is added in such an amount that the Al/OH molar ratio is about 1:3.

11. A process according to claim 9 wherein the polymeric aluminum salt is a water-soluble polyaluminumhydroxy complex with sulfate and/or chloride.

12. A process according claim 1 further comprising the step of adding said polymeric aluminum salt or the said aluminum salt, calculated as $Al_2O_3$, in an amount from about 0.01% to about 1.0% of the dry weight of the pulp to the fiber suspension.

13. A process according to claim 9 wherein the polymeric aluminum salt is a water-soluble aluminum hydroxy complex with sulfate and/or chloride, which complex contains in addition to a sulfate and/or chloride anion also other anions selected from the group consisting of silicate, oxalate and citrate.

14. A process according to claim 13 further comprising the step of adding said cationic long-claim polyacrylamide in an amount from about 0.01% to about 0.2% of the dry weight of the pulp to the fiber suspension.

15. A process according claim 14 further comprising the step of adding said polymeric aluminum salt or the said aluminum salt, calculated as $Al_2O_3$, in an amount from about 0.01% to about 1.0% of the dry weight of the pulp to the fiber suspension.

16. The process of claim 1 wherein said filler is calcium carbonate.

* * * * *